United States Patent [19]

Hara et al.

[11] Patent Number: 4,625,617

[45] Date of Patent: Dec. 2, 1986

[54] SUPPORT APPARATUS FOR SOUND MEMBERS OF MUSICAL INSTRUMENT

[75] Inventors: Kenichiro Hara, Hamamatsu; Shizuo Nakamura, Kakegawa, both of Japan

[73] Assignee: Kabushiki Kaisha Kawai Gakki Seisakusho, Shizuoka, Japan

[21] Appl. No.: 754,625

[22] Filed: Jul. 12, 1985

[51] Int. Cl.[4] ..... G10D 13/08

[52] U.S. Cl. ..... 84/404; 84/403

[58] Field of Search ..... 84/402–410

[56] References Cited

U.S. PATENT DOCUMENTS 1,791,720 2/1931 Exter ..... 84/404

2,943,527 7/1960 Hanert ..... 84/403

FOREIGN PATENT DOCUMENTS 1117161 6/1968 United Kingdom ..... 84/402 R

*Primary Examiner*—Lawrence R. Franklin

*Attorney, Agent, or Firm*—Michael N. Meller

[57] ABSTRACT

A support apparatus for sound members in a musical instrument of the type where a musical sound of predetermined frequency is generated by each sound member in response to the impact of a corresponding striking member. The striking members are activated by corresponding keys such as in toy piano. The sound members are attached to a pair of elongated elastic seat members by an adhesive agent. The seat members support the sound members and are in turn supported by a pair of supporting members.

3 Claims, 7 Drawing Figures

SUPPORT APPARATUS FOR SOUND MEMBERS OF MUSICAL INSTRUMENT

FIELD OF THE INVENTION

The invention relates to an apparatus for supporting each of a plurality of sound members arranged side by side at predetermined intervals in a musical instrument such as a toy piano or the like. Each sound member is supported at two points corresponding to vibration nodes such that the ends are free to vibrate upon striking, thereby generating a musical sound of predetermined frequency.

BACKGROUND OF THE INVENTION

A support apparatus of the above-described type is known in the prior art, such a prior art device being depicted in FIG. 1. FIG. 2 is a sectional view taken along the line II—II in FIG. 1. This type of apparatus comprises a long supporting base a on which an elongated elastic seat member b made of urethane foam or the like is adhered. The plurality of sound members d are mounted on the seat member b, with adjacent sound members having elastic partitioning members c therebetween and adhered thereto. The sound members d are lightly held in place by a pair of pressing rails f, each having an elastic strip member e adhered thereto.

This conventional type apparatus is disadvantageous in that manufacture of each elastic partitioning member and adherence thereof to the respective seat member b are extremely troublesome operations because the elastic partitioning members c mounted on each elastic seat member b are extremely small in thickness, and an integral molding of those elastic partitioning members c with the elastic seat member b is difficult. Furthermore, when a sound member d is struck with a hammer, the sound member is liable to be moved in its longitudinal direction, so that the supported points thereof are deviated from the vibration nodes. As a result of this deviation, the damping sound thereof is shortened in time or the tone quality thereof is changed, and accordingly the tone qualities and sound volumes produced during operation of a plurality of keys become irregular.

SUMMARY OF THE INVENTION

The object of the invention is to provide an apparatus which is free of the foregoing disadvantages. This object is achieved in the invention by mounting the plurality of sound members, each sound member being mounted at points corresponding to the vibration nodes, on a pair of elongated elastic seat members to which the sound members are adhered by means of an adhesive agent. The elastic seat members are in turn supported by respective supporting members.

In accordance with the invention, the plurality of sound members are arranged side by side at predetermined intervals, each sound member being adhered to the elastic seat members at two points corresponding to the vibration nodes such that the ends of each sound member are free to vibrate. As a result the supported points of each member do not deviate from the respective vibration nodes when the support member is struck by a hammer. Thus, a musical sound of regular volume and tone quality is generated by each struck sound member.

BRIEF DESCRIPTION OF THE DRAWINGS

The preferred embodiment of the invention will now be described in greater detail with reference to the drawings, wherein.

DETAILED DESCRIPTION OF THE PREFERRED EMBODIMENTS

Figure 1:
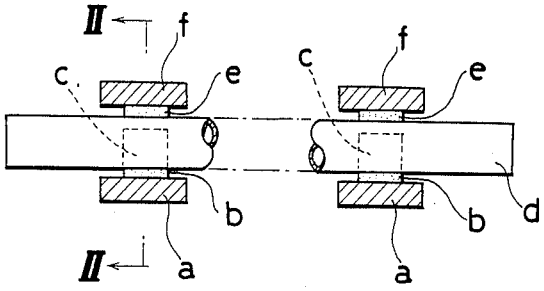
FIG. 1 PRIOR ART
FIG. 1 is a sectional side view of the supported sound member in accordance with a prior art supporting apparatus.
Figure 2:
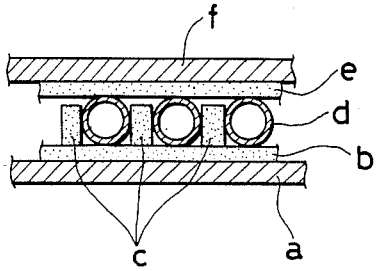
FIG. 2 PRIOR ART
FIG. 2 is a sectional view taken along the line II—II in FIG. 1.

As previously noted FIGS. 1 and 2 are different views of a prior art support apparatus. FIGS. 3–7 illustrate the preferred embodiment of the invention as applied to a keyed instrument such as a toy piano.

Figure 6:
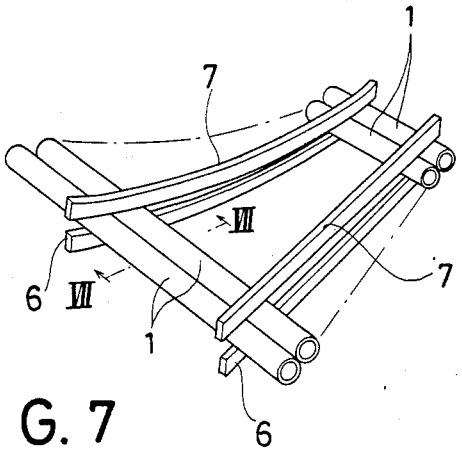
FIG. 6 is a perspective view of the support apparatus in accordance with the preferred embodiment.
Figure 7:
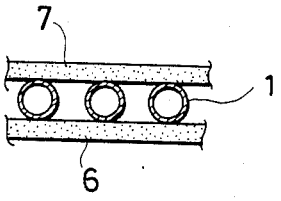
FIG. 7 is a sectional view taken along the line VII—VII in FIG. 6.

As can be best seen in FIG. 6, sound member 1 comprises a tube of circular cross section, these tubes being made of steel, aluminum, or other suitable metal. A plurality of sound members are arranged in parallel at predetermined intervals to form a side-by-side array. Each sound member has a length dependent upon the pitch to be produced. The sound members vary in length from the shortest to the longest such that successively lower-pitched sounds are produced when the sound members are struck in order of increasing length, i.e. the shortest sound member produces the highest-pitched sound and the longest sound member produces the lowest-pitched sound.

Figure 3:
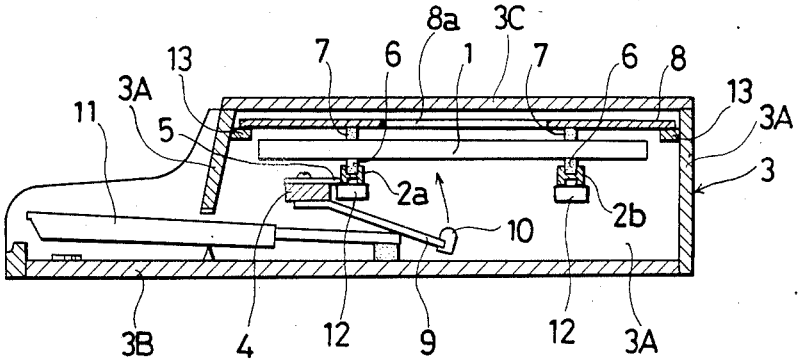
FIG. 3 is a sectional side view of a toy piano in accordance with the preferred embodiment of the invention.
Figure 4:
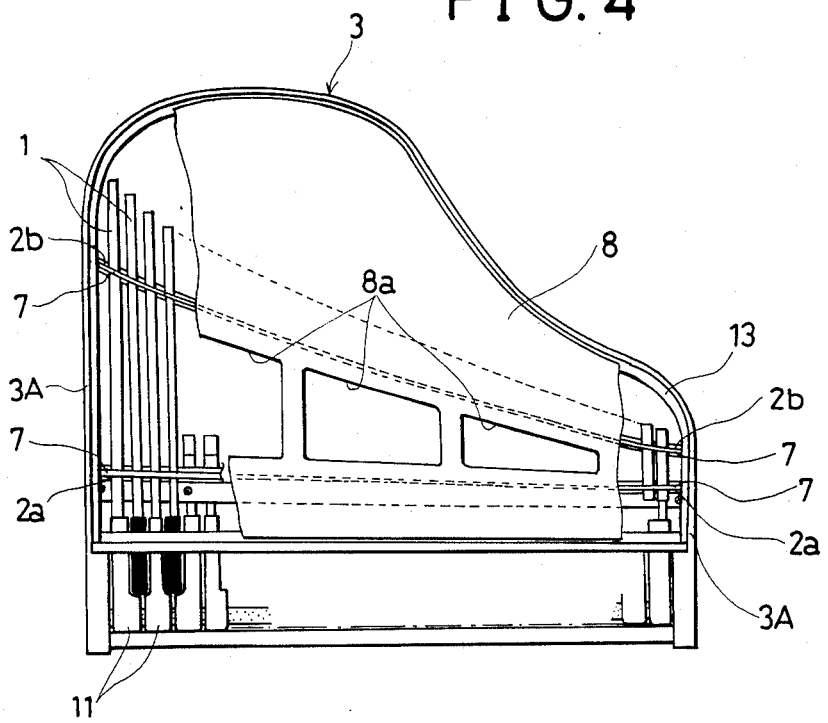
FIG. 4 is a partial top plan view of the toy piano depicted in FIG. 3.
Figure 5:
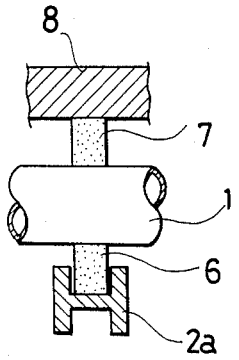
FIG. 5 is an enlarged sectional side view of the support apparatus in accordance with the preferred embodiment.

Each sound member 1 is supported at two points by a long front supporting member **2*a* and a rear supporting member 2*b* as depicted in FIG. 3. The front supporting member 2*a* is substantially straight, whereas the back supporting member 2*b* is curved (see FIG. 4). For each sound member 1** the point supported by the respective supporting members are chosen to correspond to the vibration nodes of a fundamental frequency, so that the ends are free to vibrate. As is well known by those practitioners having ordinary skill in the art, the distance separating the support points for each sound member will depend on the length of the sound member.

The supporting members **2*a* and 2*b* can be made of a rigid material such as steel, aluminum, or other suitable metal, and are formed to have H-shaped cross sections. Each supporting member is fixedly mounted at its both end portions on a pair of base members 12 fixed respectively to the opposing side panels 3A of casing 3, and is supported at a point in the middle portion thereof. The front supporting member 2*a* is supported at a middle portion by an arm member 5 (see FIG. 3) projecting from a hammer shank rail 4 which prevents the bowing of supporting member 2*a* in the downward direction, and the rear supporting member 2*b* is supported at a middle portion by a supporting stud (not illustrated) provided on a shelf panel 3B**.

An elongated elastic seat member 6 made of urethane foam, neoprene or the like is adhered to each of the supporting members 2*a*, 2*b* (see FIG. 3). The plurality of sound members 1 are mounted and fixed, by means of a viscous adhesive agent, to an upper surface of each of the elastic seat members 6 such that respective predetermined intervals are formed therebetween (see FIG. 7).

The sound members 1 are lightly held down from above by a pressing plate 8 (see FIG. 5) by way of a pair of elongated elastic holding members 7, each of which overlies a corresponding one of the elastic seat members 6. Each of these holding members 7 is adhered to the pressing plate 8. The pressing plate 8 is fixedly mounted, at its peripheral edge portion on a peripheral base member 13 fixed to the peripheral side panels 3A of casing 3.

As shown in FIG. 3, each hammer shank 9 is attached at its one end to the hammer shank rail 4. A hammer 10 is fixed to the other end of each hammer shank. Each hammer shank 9 is coupled to a corresponding key 11 such that when the key 11 is depressed, the hammer shank 9 swings upward until the hammer 10 strikes the corresponding sound member 1.

The pressing plate 8 is provided with a sound emitting opening 8*a* made therein, and a roof panel 3C is connected by hinges to the casing 3 so as to be turnable thereabout to open and close, so that a sound generated by striking any of the sound members 1 with the hammer 10 is emitted through the opening 8*a* to the outside.

In the above-described preferred embodiment the elastic holding members 7 are fixed by means of an adhesive agent to the pressing plate 8, but are not adhered to the sound members 1. However, it would be obvious to one having ordinary skill in the art that the holding members 7 need not be fixed by means of an adhesive agent to the pressing plate 8 but rather can be adhered to the sound members 1.

In manufacturing of the apparatus, such an assembling procedure is preferable that, firstly, the holding members 7, 7 are adhered to the pressing plate 8, and then the sound members 1 are adhered to the holding members 7, 7 and the elastic seat members 6, 6 are then adhered to the sound members 1 in sequence and the resultant assembly is mounted on the supporting members 2*a*, 2*b* while the elastic members 6, 6 are being mounted in and adhered to the supporting members 2*a*, 2*b* provided in the casing 1.

As a result of the novel construction of the support apparatus in accordance with the invention, when any sound member is struck by a hammer as a result of the depression of the corresponding key 11, the mutual intervals between adjacent sound members 1 cannot be altered and the sound members 1 cannot be moved in their longitudinal direction. The displacement of each sound member upon hammer impact is prevented by the securement of the sound members to the elastic seat members by means of adhesive and by the abutment of the elastic holding means 7 which are supported by the securely mounted pressing plate 8.

Furthermore, in the case where the sound members 1 are adhered to the elastic holding members 7, and the holding elastic members 7 and the pressing plate 8 are not adhered together, the sound members 1 can be kept in their predetermined positions more firmly than is the case when the sound members are adhered to the elastic seat members 6 only.

Moreover, in accordance with another embodiment, if the holding members 7 are adhered to the sound members 1, the pressing plate may be omitted.

In yet another embodiment of the invention the roof panel 3C of the casing 3 may be modified into a stationary one fixed to the casing 1, and in this case, the stationary roof panel may serve to press the holding members 7 in place of the pressing plate 8, and may be provided with the sound emitting opening 8*a* though not illustrated. As for the adhesive agent, a pressure sensitive adhesive double coated tape may be used.

Thus, in accordance with the invention, the sound members 1 are adhered to the seat members 6, which are in turn supported by the supporting members 2*a* and 2*b*, such that lateral and longitudinal displacement of the sound members is prevented during the impact of striking hammers or the like. Consequently, irregularity in the tone quality or the volume generated by each vibrating sound member can be prevented.

The foregoing description of the preferred embodiment is presented for illustrative purposes only and is not intended to limit the scope of the invention as defined in the appended claims. Modifications may be readily effected by one having ordinary skill in the art without departing from the spirit and scope of the inventive concept herein disclosed.

What is claimed is:

1. A supporting apparatus for the sound members of a musical instrument of the type having a plurality of sound members and a corresponding plurality of striking members, each of said sound members being supported at two points corresponding to the respective fundamental vibration nodes of a two-free-end type vibration of said sound member such that the ends of said sound member are free to vibrate, and being arranged to vibrate in response to the impact of a corresponding one of said striking members for generating a musical sound of a predetermined frequency, said sound members being disposed side by side at predetermined intervals, wherein said support apparatus comprises first and second elongated elastic seat members, first and second supporting members, and first and second elongated elastic holding members, each of said sound members being mounted, at said two points of support, on said first and second seat members which are in turn respectively supported by said first and second supporting members, and said first and second holding members being arranged to oppose and overlie said first and second seat members respectively, each of said first and second seat members being attached to and below each of said sound members and each of said first and second holding members being attached to and above each of said sound members by means of an adhesive agent.

2. The support apparatus as defined in claim 1, further comprising a pressing plate arranged to contact said first and second holding members.

3. In a musical instrument consisting of a plurality of sound members arranged in parallel and at predetermined intervals, a support apparatus for supporting said sound members at two points corresponding to the respective vibration nodes such that the free ends of each sound member are free to vibrate, and a plurality of striking members, each of said striking members being arranged to strike a corresponding one of said sound members for generating a vibration corresponding to a musical sound of a predetermined frequency, the improvement wherein said support apparatus comprises first and second elongated elastic seat members, first and second supporting members, and first and second elongated elastic holding members, each of said sound members being mounted, at said two points of support, on said first and second seat members which are in turn respectively supported by said first and second supporting members, and said first and second holding members being arranged to oppose and overlie said first and second seat members respectively, and each of said sound members being attached to said first and second seat members and to said first and second holding members by means of an adhesive agent.

* * * * *